US006481161B1

(12) United States Patent
Thurnher

(10) Patent No.: US 6,481,161 B1
(45) Date of Patent: Nov. 19, 2002

(54) DRIVE DEVICE FOR A SLIDING PANEL

(76) Inventor: Julius Thurnher, Friedrich Schlöglg. 4, Purkersdorf A-3002 (AT)

( * ) Notice: Subject to any disclaimer, the term of this patent is extended or adjusted under 35 U.S.C. 154(b) by 0 days.

(21) Appl. No.: 09/857,737

(22) PCT Filed: Dec. 2, 1999

(86) PCT No.: PCT/AT99/00296

§ 371 (c)(1),
(2), (4) Date: Jun. 8, 2001

(87) PCT Pub. No.: WO00/34609

PCT Pub. Date: Jun. 15, 2000

(30) Foreign Application Priority Data

Dec. 10, 1998 (AT) ..... 2072/98

(51) Int. Cl.[7] ..... E05F 11/34
(52) U.S. Cl. ..... 49/362
(58) Field of Search ..... 49/362, 425, 409, 49/410, 411

(56) References Cited

U.S. PATENT DOCUMENTS 3,996,397 A * 12/1976 Bailey et al. ..... 49/362
4,018,005 A 4/1977 Harris
4,198,786 A * 4/1980 Monot ..... 49/362
4,365,441 A * 12/1982 Davidson ..... 49/63
4,698,938 A * 10/1987 Huber ..... 49/138
5,077,938 A * 1/1992 Moreuil ..... 49/362
5,826,377 A * 10/1998 Simson et al. ..... 49/362
6,324,789 B1 * 12/2001 Stephen ..... 49/362

FOREIGN PATENT DOCUMENTS

DE 28 19 424 8/1979

* cited by examiner

*Primary Examiner*—David M. Purol
(74) *Attorney, Agent, or Firm*—Collard & Roe, P.C.

(57) ABSTRACT

A driving device (20) for a sliding wing (2) of a sliding window (1) or a sliding door, comprising a screw (24) rotatably mounted in stationary bearings (26, 27) and driven by a motor (22), a screw nut (28) being axially displaceably arranged on the screw and non-rotationally retained by a stationary guide, and being in drive connection with the sliding wing (2), e.g. via a catch (29), wherein at least one movable bearing element (34, 35) is arranged between the stationary bearings (26, 27), which is axially freely movable along the screw (24) and non-rotationally retained, the at least one movable bearing element being jointly movable by the screw nut (28) during displacement of the latter.

11 Claims, 6 Drawing Sheets

DRIVE DEVICE FOR A SLIDING PANEL

CROSS REFERENCE TO RELATED APPLICATIONS

Applicant claims priority under 35 U.S.C. §119 of Austrian Application No. A 2072/98 filed Dec. 10, 1998. Applicant also claims priority under 35 U.S.C. §120 of PCT/AT99/00296 filed Dec. 2, 1999. The international application under PCT article 21(2) was not published in English.

The invention relates to a driving device for a sliding wing of a sliding window or a sliding door, comprising a screw rotatably mounted in stationary bearings and driven by a motor, a screw nut being axially displaceably arranged on the screw and non-rotationally retained by a stationary guide, and being in drive connection with the sliding wing, e.g. via a catch.

Automatic opening and closing of sliding windows or sliding doors is primarily desirable if the sliding wings to be moved have large dimensions, have a large mass and/or a stiff guide is provided for the sliding movement of the respective sliding wing. On the other hand, an easy-running guide of manually moved sliding wing often has the consequence that the respective sliding wing is pushed too strongly forwards or back during manual opening of closing, so that it hits too hard against abutments, such as a vertical framework section.

In the not previously published older Austrian Patent Application A 307/98, a motor drive for sliding wings has been suggested, wherein a toothed rack on the lower side of the respective sliding wing cooperates with a toothed wheel stationarily attached on the framework which is driven by an electric motor. Although this sliding wing driving device is quite advantageous, there are instances in which it cannot be used because it is necessary to attach the toothed wheel in a central region of the respective sliding window or the respective sliding door in order that the associated sliding wing may be moved past the toothed wheel into the opened position. In doing so, it is, however, necessary that the toothed wheel passes through corresponding window frame parts in this central region, resulting in accommodation and sealing problems, for instance in case of outer wings or outer windows. An attachment of the driving unit proper lateral in relationship to the sliding window or the sliding door would thus be desirable. As such, this would be attainable by a driving device comprising a screw, as it is known, e.g., from DE 2 819 424 A and DE 2 436 171 A in connection with sliding doors of vehicles etc. These known driving devices are, however, provided on the upper side of suspended sliding wings, where the screw nut passed by the screw is fixedly connected with the associated sliding door wing via a fork. These known driving devices are, however, not or poorly suited in instances where only a narrow space is available because these driving devices have complex constructions requiring quite a lot of space.

In view of a space-saving, not very massive construction it would be particularly desirable to be able to use comparatively slight dimensioned driving screws which would be quite sufficient to obtain the desired sliding wing forward movement, if no loads are to be accommodated by the screws. In doing so, however, it has been shown that a mere end-side bearing of the screw results in saggings and oscillations in the middle portion of the screw so that not only an entrainment of the sliding wing is no longer ensured by the screw nut, but also damage to the sliding wing-screw-assembly may occur. It must be taken into consideration that, e.g., the sliding wings of sliding windows often may have widths of 1.5 m or 2 m and more so that the appropriate screws must have lengths of 3 m or 4 m, or more.

It is now an object of the invention to provide a sliding wing driving device of the initially mentioned type which facilitates the use of comparatively slight-dimensioned screws and their accommodation in the respective frame construction of the sliding door, or the sliding wing, respectively, and where a bending or oscillating of the screw during operation nevertheless is safely avoided.

The inventive driving device of the initially mentioned type is characterized in that at least one movable bearing element is arranged between the stationary bearings, which is axially freely movable along the screw and non-rotationally retained, the at least one movable bearing element being jointly movable by the screw nut during displacement of the latter.

With such an embodiment, it is always possible to ensure an additional supporting or bearing of the screw by the movable bearing element in a more or less central region of the screw, or in the vicinity of the screw nut, respectively, so that particularly in the critical region, the rotating screw will be retained against bending or oscillating, respectively. In this manner, also engagement of the catch provided on the screw nut with the sliding wing to be driven can be maintained, this engagement as a rule being obtained by a simple stop which now is kept, without movement, in abutment on the associated part of the sliding wing, instead of hitting against it in accordance with oscillations of the screw. The screw traverses the movable bearing element freely, i.e. without thread engagement, so that the movable bearing element is freely displaceable on the screw, and therefore it is simply jointly moved with the screw nut when the latter is displaced and it abuts against this movable bearing element. During rearward movement of the screw nut, the latter may entrain the movable bearing element, e.g. via a pulling connection, such as a pulling rod or rail, in the manner of dragging it along.

An additionally improved support and securing of the screw in the region of the screw nut is obtained if at least one movable bearing element is provided on each side of the screw nut. In doing so, the total of at least two movable bearing elements are located at a certain distance from each other for a distributed screw support, and when driving the screw and thus displacing the screw nut, the latter always takes along one of the movable bearing elements by pushing it ahead in front of it, and the other movable bearing element is dragged along, so that also in this instance the entrainment, or co-displacement, described is ensured. Here, it is also suitable to directly interconnect the movable bearing elements instead of connecting them to the screw nut, so that always that bearing element which is pushed forwards by the screw nut will drag along the (one or more) other bearing element(s).

To connect the movable bearing elements, pulling rods, as already mentioned, may be used, e.g. with end-side abutments on the outer side of the bearing elements or in fixed connection therewith, the pulling rods engaging in bores provided in the bearing elements and optionally passing through the same. A particularly simple and space-saving, light-weight, yet nevertheless efficient construction is, however, obtained if the the movable bearing elements are interconnected by at least one flexible pulling element, such as a wire, a cord or the like.

For the movable bearing elements, separate guiding rods or guiding rails could be provided so as to hold them against rotation, yet for a simple embodiment doing away with additional components it is advantageous if the movable bearing element(s) is/are block-shaped and is/are slidingly received in a guiding channel of a horizontal section guiding rail of the stationary framework. In this embodiment, thus, the movable bearing elements are directly accommodated in a section guiding rail of the framework of the sliding wing which is already present to guide the sliding wing. In particular, for having to design the driving device merely with a view to the horizontal displacement movement of the sliding wing and to free it from any loads, the section guiding rail can take up the entire weight of the sliding wing, and in this context it is, therefore, particularly suitable if the sectional guiding rail in which the movable bearing elements are accommodated is the lower guiding rail of the stationary framework. Suitably, the guiding channel then also receives the block-shaped screw nut.

In this embodiment, thus the movable bearing elements and the screw nut are consecutively arranged along the screw within the guiding channel, and to avoid a connection of the movable bearing elements via projections or the like outwardly projecting beyond the guiding channel, it has proven particularly advantageous if the at least one pulling element freely traverses a bore or a longitudinal recess in the screw nut. Preferably, two wires, cords (or rods) are provided which extend on either side of the screw and pass through the screw nut so as to safely avoid a possible wedging of the dragged along bearing element in the guiding channel.

In the present screw driving device, the screw may be driven from one side of the sliding window, or sliding door, respectively, wherein, however, the framework in a vertical, lateral frame part generally offers little space for accommodating the driving motor. However, in general, space conditions on the lower side of the sliding window or the sliding door are more favorable, and accordingly it is advantageous if the the framework accommodates the motor in a recess in the lower frame part, which motor drives the screw via a toothed belt or a chain arranged in a lateral frame part.

For a particularly simple coupling of the sliding wing with the screw nut it has proven suitable if the block-shaped screw nut comprises a pin-shaped catch which projects through a slit-shaped longitudinal opening of the sectional guiding rail and engages a section-frame of the sliding wing.

With a view to a lasting, weather-proof embodiment, it is also advantageous if the movable bearing element(s) is/are made of a highly polymerized plastics, such as, e.g., polyoxymethylene or polyamide. For the guidance on the screw it is, moreover, suitable if the movable bearing element(s) comprises/comprise a reinforcing bearing sleeve, preferably made of metal, which is traversed by the screw.

On the other hand, it is advantageous for a stable configuration if the movable bearing element(s) is/are made of metal, preferable of brass.

The invention will now be explained in more detail by way of preferred exemplary embodiments illustrated in the drawings, to which, however, it shall not be restricted. In detail, FIG. 1 shows a schematic view of a sliding window having a screw drive for the outer sliding wing;

Figure 1:
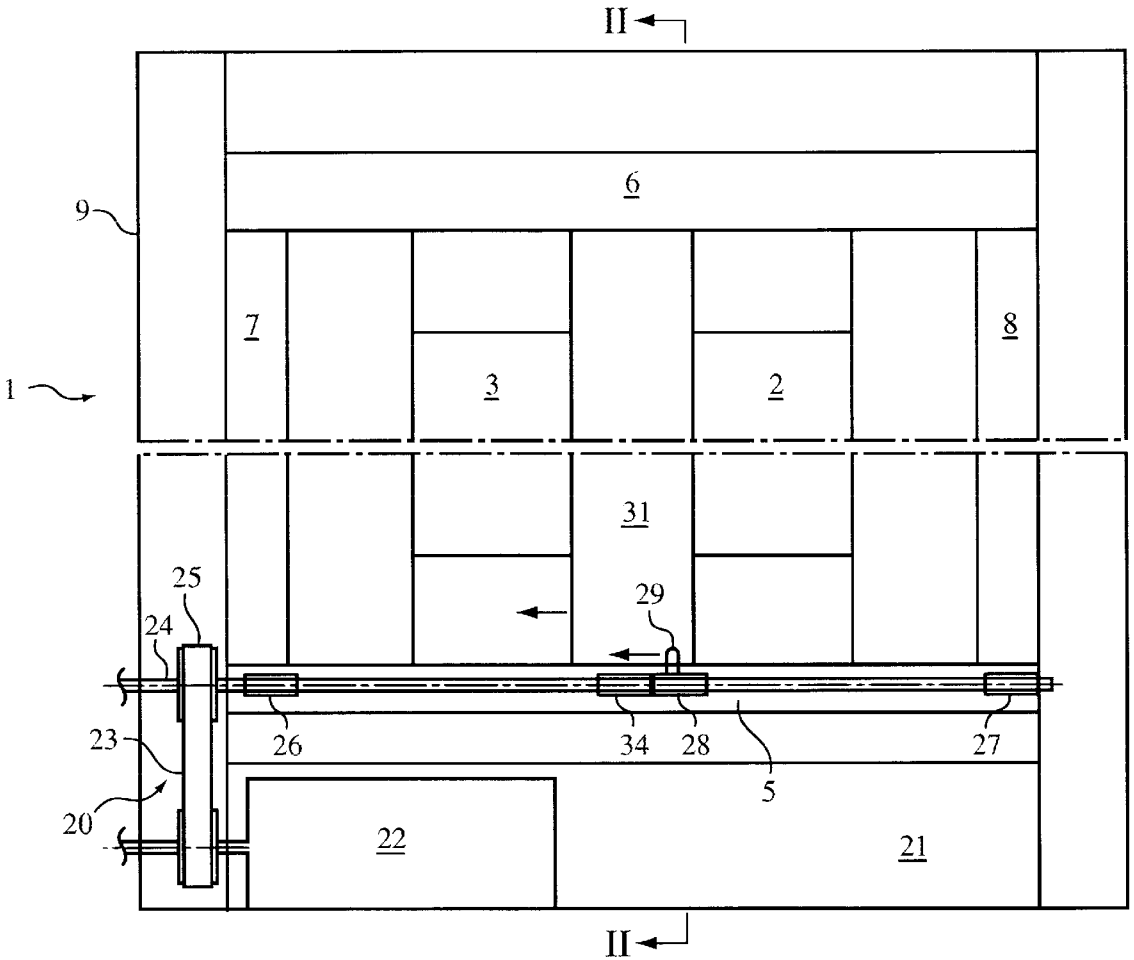
Figure 2:
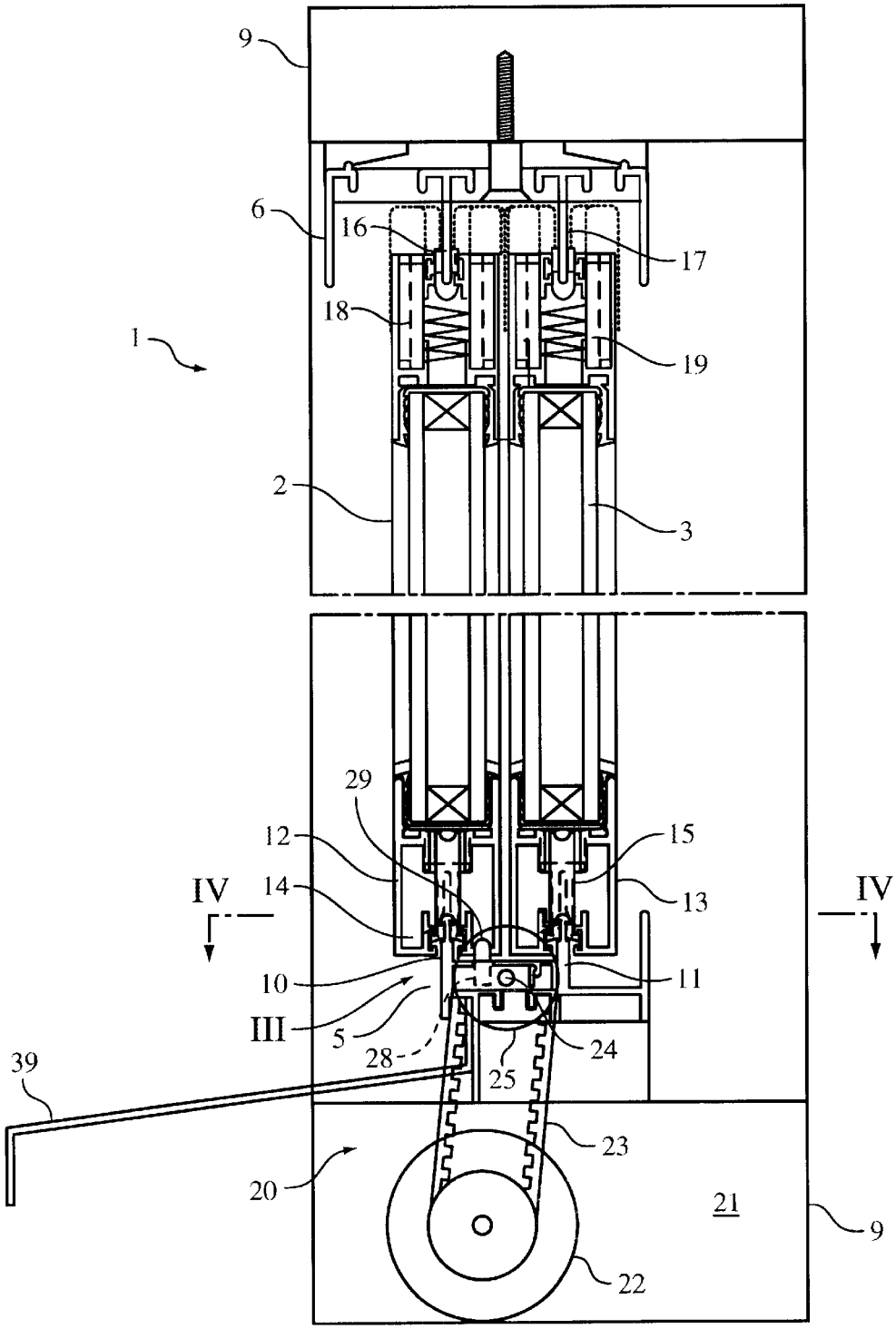
FIG. 2 shows a vertical section through a part of such a sliding window according to line II—II in FIG. 1.

In FIG. 1, a conventional sliding window generally denoted by 1 is shown in a schematic view, wherein two sliding wings 2, 3 made of glass are visible which are illustrated in the closed position in which they over-lap each other by their inner, vertical rims, cf. also FIG. 2. The illustrated sliding window 1 is provided with a stationary framework 4 provided with a lower sectional guiding rail 5, an upper sectional guiding rail 6 as well as vertical side sections 7, 8. These stationary sections 5 to 8 are inserted in a window frame 9 indicated merely schematically, wherein the individual rails 5, 6 and the lateral sections 7, 8 may, for instance, be screwed to the frame parts of the window frame 9 with a sealing (not illustrated) interposed, and they serve as guide and bearing of the sliding wings 2, 3.

Figure 3:
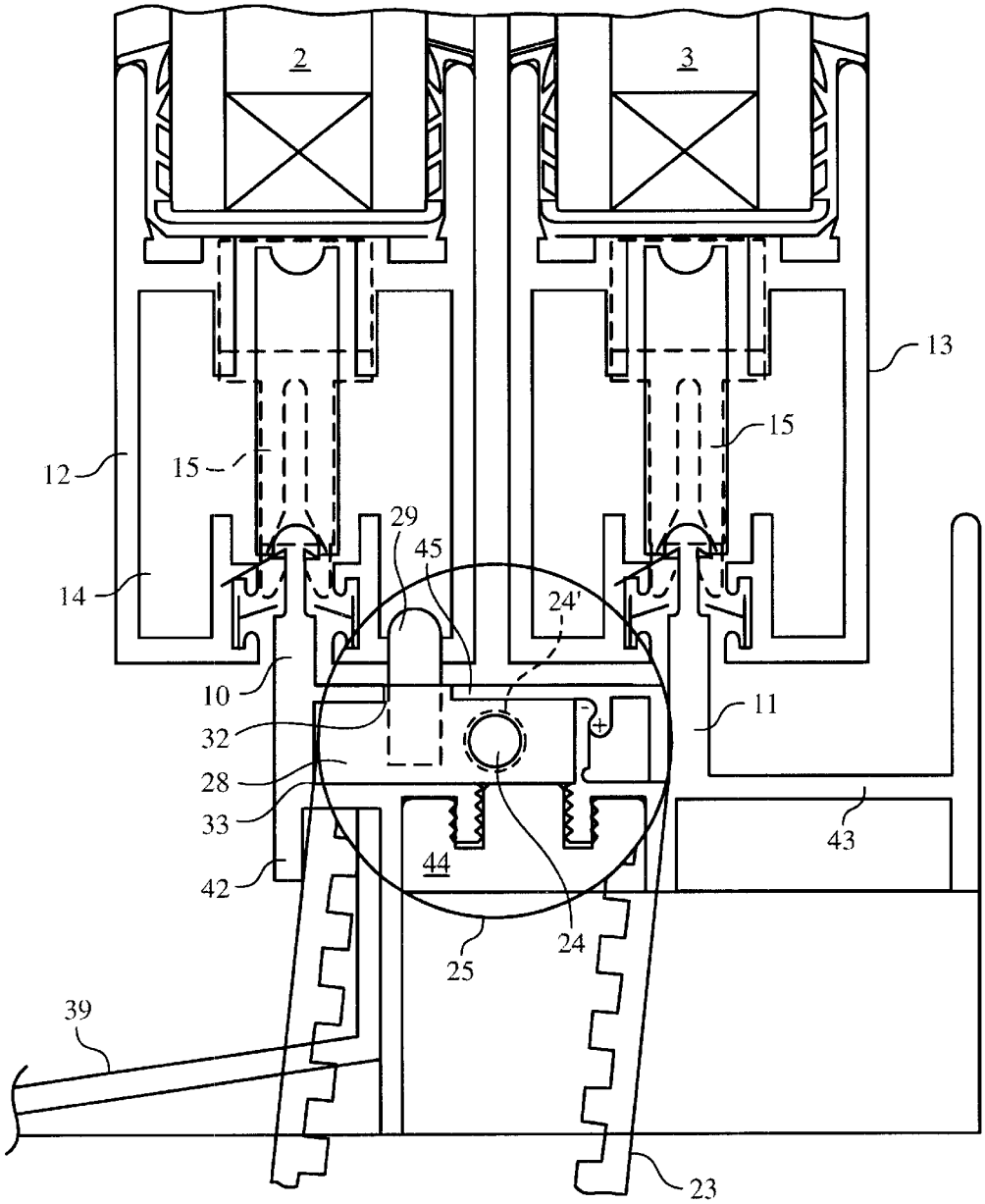
FIG. 3 shows the lower region (cf. arrow III) of this vertical section according to FIG. 2 on a larger scale.

According to FIGS. 2 and 3, the lower guiding rail 5 comprises upright guiding webs 10, 11 on which the respective sliding wings 2, 3 made of glass slide with their lower horizontal edge or frame sections 12, 13, termed sectional frames in the following. On the upper side (cf. FIG. 2), the sliding wings 2, 3 are guided in the upper guiding rail 6. As is apparent from FIG. 2, a vertical play remains at the upper side of the sliding wings 2, 3 which is necessary for mounting, and to avoid a subsequent undesired lifting or tilting of the sliding wings 2, 3, a locking snap element 15 is provided on a horizontal web of a plastics block 14 of each lower sectional frame 12, 13, which snap element is snapped onto the associated guiding web 10, or 11, respectively, of the lower guiding rail 5. For this purpose, this guiding web 10, or 11, respectively, comprises longitudinally extending latching indentations not denoted in detail into which the respective locking snap element 15 engages with its, e.g., barb-shaped lower end, thereby allowing for an anchoring of the sliding wing 2, or 3, respectively, on the guiding web 10, or 11, respectively. Yet, naturally, the locking snap elements 15 slide along the respective guiding web 10, or 11, respectively, in the longitudinal direction thereof, i.e. perpendicular to the plane of drawing in FIGS. 2 and 3. This lift and tilting safety means has been described in detail in the not previously published older WO 99/32747 A, and therefore, no further description thereof is required.

At the upper side, each sliding wing 2, 3 is guided in the upper guide rail 6 by webs 16, 17 which, moreover, cooperate with telescopingly upwardly and downwardly movable sealing units 18, 19, merely quite schematically illustrated in FIG. 2, said sealing units being provided at the front ends of the sliding wings 2, 3 in the region overlapping in the closed position, as has further been described in the older, not previously published WO 99/32753 A and thus need not be further explained here.

To motor-drive the sliding wing 2 which is the outer one according to the illustration of FIGS. 1 and 2, by means of a motor, an electric driving device is provided generally denoted by 20 in FIGS. 1 and 2, which driving device comprises an electric motor 22 arranged in the lower stationary framework part 21 below the sliding wing 1, said motor being capable of driving a toothed wheel or pinion 25 which is non-rotationally attached on a horizontal screw 24, via a toothed belt 23. As schematically illustrated in FIG. 1, the screw 24 is rotatably mounted in fixed, i.e. stationary, bearings 26, 27 close to its ends, and on this screw a screw nut 28 is arranged, i.e. an e.g. block-shaped catch member held against rotation relative to the screw 24 and axially displaceable along the screw 24 when the latter is rotated, which catch member, via a catch 39 which in particular is pin-shaped, is capable of taking along the sliding wing 2 which is the right-hand one in FIG. 1, in the direction of the arrow, towards the left according to the illustration in FIG. 1. For this purpose, the pin-shaped catch 29 projects into a recess 30, quite schematically indicated in FIG. 5, on the lower side of the frame of the sliding wing 2, e.g. the vertical section frame 31, which is the left one in FIGS. 1 and 5, of this outer sliding wing 2, or, preferably, in the lower section frame 12, cf. FIG. 2, where in the lower side of this horizontal frame section 12 simply an opening may be provided as the recess 30 for the pin-type catch 29, as is apparent from FIGS. 2 and 3. The pin-type catch 29 may be formed by a metallic pin which is screwed or pressed into a bore on the upper side of the screw nut 28. On the other hand, the screw nut 28 itself may be block-shaped and made of plastics, it does, however, suitably have an, e.g. pressed in or glued in, tapped bush which traverses the screw nut horizontally, and by which the screw nut is screwed onto the screw 24 (which, however, for the sake of simplicity is not illustrated in detail in the drawing but is merely schematically indicated at 24' in FIG. 3).

The screw 24 may have a left-handed thread or a right-handed thread, and suitably it is made of a rust-proof metal, e.g. brass. In the region of the screw nut 28, furthermore, a per se conventional lubricating means not illustrated may be provided, and moreover, suitably an antisoiling device (not illustrated) is arranged in the region of the screw 24.

In detail, the pin-shaped catch 29 passes through a slit-shaped longitudinal opening 32 in the upper side of the lower horizontal guiding rail 5 which is present above a guiding channel 33 formed in this guiding rail 5 for the screw nut 28. The pin-shaped catch 29 projects through this longitudinal opening 32 and is moved along this longitudinal opening 32 when the screw nut 28 is displaced due to a rotation of the screw 24. For sealing purposes and for rejecting dirt, this longitudinal opening 32 may be provided with a flexible longitudinal sealing strip on both rims of the opening (not illustrated), which normally will upwardly seal the longitudinal opening 32 yet will elastically deform locally for the passage of the pin-shaped catch 29.

Figure 4:
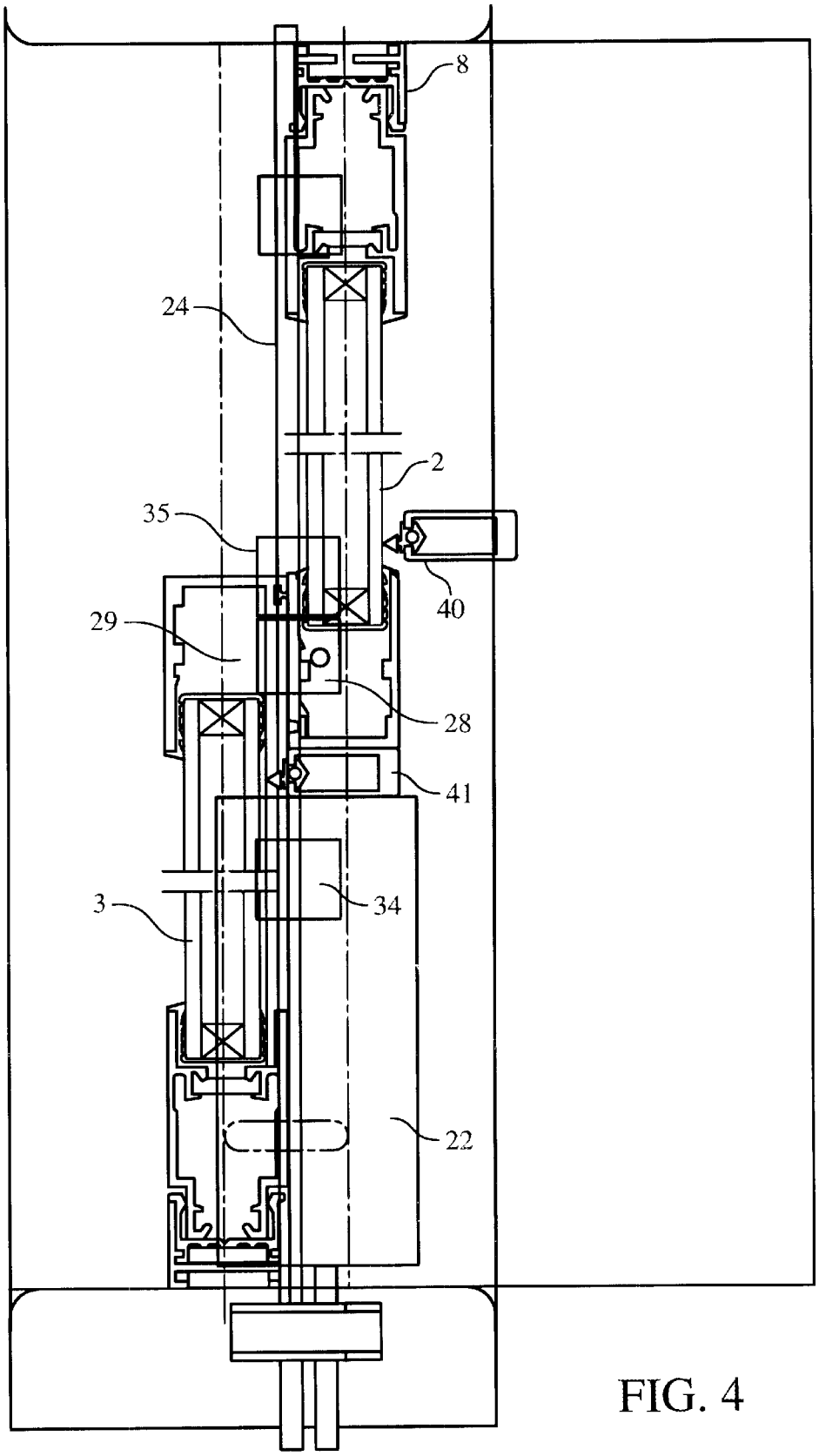
FIG. 4 shows a schematic horizontal section, not true to scale, through the sliding window according to line IV—IV in FIG. 2, having a screw bearing that is somewhat modified relative to that of FIG. 2.

Since the screw 24 may have a length of 3 m, 4 m or even more, yet, on the other hand, should be as light in dimension as possible so as to save space and costs, without additional provisions it could be possible for the screw 24 to oscillate or make an excursion during rapid rotation of the screw 24, primarily in its middle region between the end-side stationary bearings 26, 27. Such an oscillation in this region would be particularly disadvantageous if the screw nut 28 happened to be just in this region, as is illustrated in FIG. 1. Therefore, to additionally support and carry the screw 24 in this region, or in the vicinity of the screw nut 28, respectively, without, however, impeding the screw nut 28 during its driving movement (to the left hand in direction of the arrow, according to the illustration of FIG. 1), according to FIG. 1 a freely-movable additional bearing element 34 is provided on the screw 24, which is freely—i.e. without threaded engagement—traversed by the screw 24, which, however, supports and retains the screw 24 with regard to radial excursion movements. As has already been mentioned, in the embodiment according to FIG. 1 merely one single movable bearing element 34 of this type is provided, i.e. on the left hand of the screw nut 28 in the exemplary embodiment illustrated, preferably, however, two such movable bearing elements 34, 35 are arranged, as is illustrated in FIGS. 4 to 6; in that case, one movable bearing element 34, or 35, respectively, is each mounted respectively on the one and on the other side of the screw nut 28.

The movable bearing element 34, or the movable bearing elements 34, 35, respectively (also more than two may be provided) move along screw 24 similar to supporting backrests, if the screw nut 28 is displaced and entrains it (them), and they act as a bearing for the screw 24 and relieve the screw nut 28 as regards possible supporting reaction forces.

Figure 5:
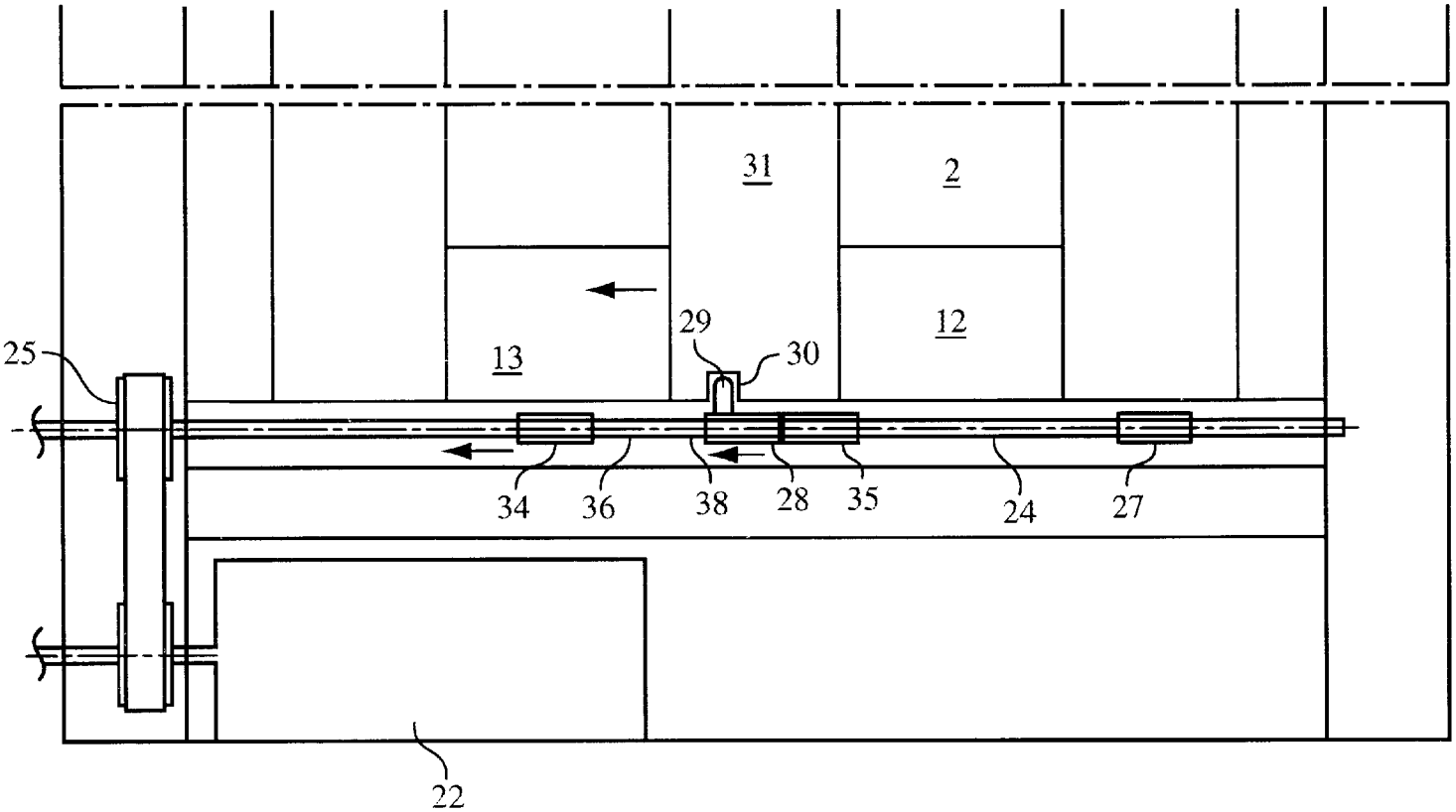
FIG. 5 shows a schematic view to clearly illustrate the screw drive, or the screw bearing, respectively.
Figure 6:
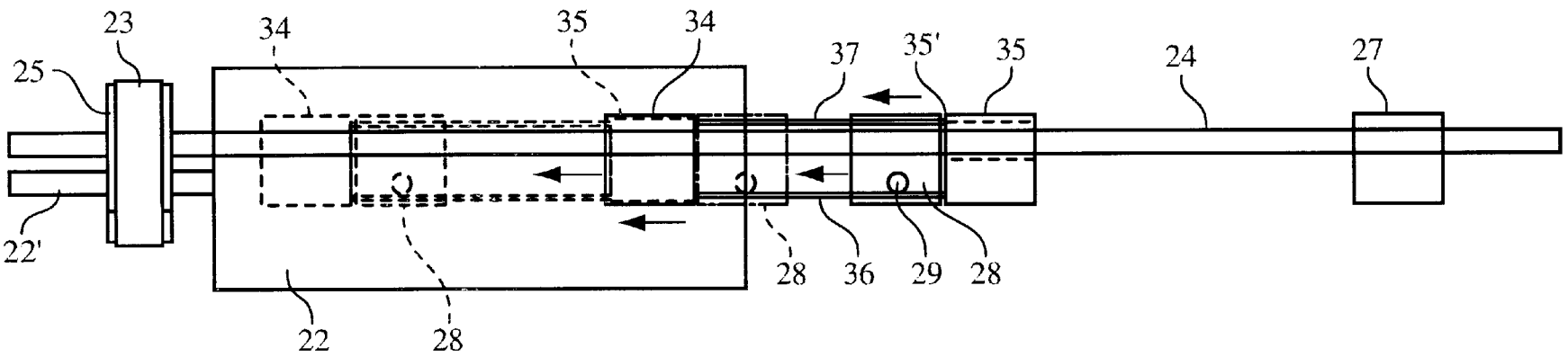
FIG. 6 shows a schematic top view onto the driving device, in correspondence with FIG. 5.

The two movable bearing elements 34, 35 are interconnected by two lateral pulling elements 36, 37 in the form of wires, cords or the like, optionally also rods, as is apparent from FIGS. 5 and 6.

In the embodiment according to FIG. 1, the screw nut 28 may be connected with the one movable bearing element 34 via corresponding pulling elements not illustrated in detail so as to enable it to haul it along during a closing movement, according to the illustration in FIG. 1 towards the right-hand side. If the screw nut 28 is moved towards the left, however, in the embodiment of FIG. 1, the screw nut 28 will push the movable bearing element 34 ahead. As has been mentioned, the connection or pulling element, respectively, may be a wire or a cord, i.e. a flexible pulling element, also in case of FIG. 1, it being also conceivable to determine the length of the pulling element such that a distance will be maintained between the movable bearing element 34 and the screw nut 28 (that is during a movement towards the right in FIG. 1) when the former is pulled along.

Such a distance is present in comparable manner between the two movable bearing elements 34, 35 in the embodiment according to FIGS. 4 to 6, and, even if made as flexible elements (wire, cord), the two pulling elements 36, 37 practically will always be kept tensioned if the screw nut 28 pushes the one or the other movable bearing element 34, or 35, respectively, ahead. In this instance, the pulling elements 36, 37 will extend through bores or lateral, groove-type longitudinal recesses 38 in the screw nut 28 (cf. FIG. 5).

For instance, if the outer sliding wing 2 is to be moved into the opened position, i.e. towards the left according to the representation in the drawing, screw 24 will be rotatably driven such that the screw nut 28 will begin to move in arrow direction towards the left. In the embodiment according to FIG. 1, the screw nut immediately pushes forward the single movable bearing element 34 ahead of it, this bearing element 34 in a position immediately adjacent this screw nut 28 supporting the screw 23 and serving as a bearing for the screw. In the embodiment according to FIGS. 4 to 6, the screw nut 28 after a short period of time will abut against the left-hand movable bearing element 34, as indicated in FIG. 6 in dot-and-dash lines, and from this time onwards, the screw nut 28, during the movement towards the left, will push forwards the left-hand movable bearing element 34 in front of it until, e.g., the left-hand end position indicated in FIG. 6 by broken lines is reached, in which the sliding wing 2 is (cf. FIG. 4 or 5) in the opened position. If subsequently the sliding wing 2 is to be moved back into the right-hand closed position, the screw nut 28 will be driven in the opposite sense of rotation, so that it will move toward the right, in doing so will run up against the right-hand movable bearing element 35 after a short period of time and subsequently will push the latter ahead in front of it until the closed position of the sliding wing 2 has been reached. This position is shown in full lines in FIG. 6, as regards the screw nut 28 and the movable bearing elements 34, 35. During this movement into the closed position, i.e. according to the drawing, towards the right, the right-hand movable bearing element 35 entrains the left-hand movable bearing element 34 therebehind via the pulling elements 36, 37.

As is apparent, the present driving device 20 can be accommodated in the range of the stationary frame-work region on the lower side of the sliding window (or also of a sliding door) in an extremely space-saving manner, and, moreover, it does not impede the remaining functions, in particular in the region of the outer sliding wing 2, since the screw 24 is driven from the side of the sliding window 1, or sliding door, respectively, via the toothed wheel 25. In this manner, e.g., the arrangement of a rain-protection angle member 39 in the region of the window sill is without any problem, and neither are there any problems with a view to tightness. Any possible rain water entering the guiding channel 33 may be guided downwardly and outwardly from there, towards the angle member 39, in a per se conventional manner.

The described driving device 20 comprising the screw 24 is particularly advantageously suitable for a sliding window or sliding door configuration comprising automatic cleaning means, where, e.g., a stationary cleaning ledge 40 (for cleaning the sliding wing 2) as well as a movable cleaning ledge 41 attached to the inner front end of the outer sliding wing 2 (the cleaning ledge 41 serves to clean the inner sliding wing 3) may be provided, cf. FIG. 4. Such a cleaning device as such has been explained in the older, not previously published WO . . . A (PCT/AT99/00218) and need not be explained here in detail.

Screw 24 may be inserted with the bearing elements 34, 35 and the screw nut 28 without any problems from the front end of the lower guiding rail 5 in the guiding channel 33 thereof, yet it is also conceivable to close the guiding channel 33 at its upper side by a removable lid ledge (which then will have the slit-shaped longitudinal opening 32 mentioned), with this lid ledge being removable so as to allow for a simple upward-removal of the screw unit comprised of the bearing elements 34 and 35 and the screw nut 28 from the guiding rail 5, for instance for maintenance of the same or for an exchange thereof. In FIG. 3, an embodiment is shown in which the lower sectional guiding rail 5 is formed by a composite section comprised of metal sections 42, 43 and an interconnecting plastics section 44, which together define the guiding channel 33; the latter is partially covered at its upper side by a snapped-on lid-section ledge 45 leaving free the gap 32 for the catch 29.

The present electric driving device 20 may furthermore cooperate in a manner known per se with limit switches, such as, e.g., microswitches, switching contacts or the like sensors, optionally also photoelectric barriers, so as to automatically switch off the motor 22 when the respective end position of the driven sliding wing has been reached. Such limit switches have not been illustrated in the drawing for the sake of simplicity.

In the drawing, an embodiment of a sliding window 1 is schematically shown where only one outer sliding wing 2 is driven. It is, as such, of course also conceivable to drive both sliding wings 2, 3 or to drive merely the inner sliding wing 3 instead of the outer sliding wing 2. In view of the previously mentioned cleaning, it has, however, proven particularly suitable if the outer sliding wing 2 is driven, and if the cleaning ledges 40, 41 are attached, as mentioned before.

The bearing elements 34, 35 as well as the screw nut 28 preferably are formed by plastics blocks, e.g. made of POM or polyamide. Optionally, as shown at 35' in FIG. 6, a reinforcing bearing sleeve made of metal, e.g. brass, may then be is inserted in these plastics blocks, in particular pressed thereinto or cast therein.

What is claimed is:

1. A sliding wing arrangement comprising a sliding wing of a sliding window or a sliding door movable along a lower horizontal sectional guiding rail; a screw rotatably mounted in stationary bearings in the lower horizontal sectional guiding rail and driven by a motor; a block-shaped screw nut axially displaceably arranged on the screw, non-rotatably retained in a guiding channel of the guiding rail and in drive connection with the sliding wing, the guiding channel being part of a stationary framework; and at least one movable block-shaped bearing element for the screw slidingly arranged between the stationary bearings, the movable bearing element being axially freely movable along the screw and non-rotatably retained, and the movable bearing element being jointly movable by the screw nut during displacement of the latter.

2. A sliding wing arrangement according to claim 1, wherein at least one respective movable bearing element is provided on each side of the screw nut.

3. A sliding wing arrangement according to claim 2, comprising two of said movable bearing elements, the bearing elements being interconnected.

4. A sliding wing arrangement according to claim 3, wherein the movable bearing elements are interconnected by at least one flexible pulling element.

5. A sliding wing arrangement according to claim 4, wherein the at least one pulling element freely passes through a bore or a longitudinal recess in the screw nut.

6. A sliding wing arrangement according to claim 1, wherein the framework accommodates the motor in a recess in a lower frame part, which motor drives the screw via a toothed belt or a chain arranged in a lateral frame part.

7. A sliding wing arrangement according to claim 1, wherein the block-shaped screw nut comprises a pin-shaped catch which projects through a slit-shaped longitudinal opening of the lower sectional guiding rail and engages with a section frame of the sliding wing.

8. A sliding wing arrangement according to claim 1, wherein the at least one movable bearing element is made of a highly polymerized synthetic resin.

9. A sliding wing arrangement according to claim 8, wherein the at least one movable bearing element comprises a reinforcing bearing sleeve which is traversed by the screw.

10. A sliding wing arrangement according to claim 1, wherein the at least one movable bearing element is made of metal.

11. A sliding wing arrangement according to claim 1, wherein the block-shaped screw nut is in drive connection with the sliding wing by means of a catch.

* * * * *